US010190279B2

(12) United States Patent
Thomas

(10) Patent No.: US 10,190,279 B2
(45) Date of Patent: Jan. 29, 2019

(54) PILE FOR AN OFFSHORE MONOPILE TYPE FOUNDATION STRUCTURE

(71) Applicant: Innogy SE, Essen (DE)

(72) Inventor: Christopher Mark Thomas, Caerphilly (GB)

(73) Assignee: INNOGY SE, Essen (DE)

( * ) Notice: Subject to any disclaimer, the term of this patent is extended or adjusted under 35 U.S.C. 154(b) by 0 days.

(21) Appl. No.: 15/372,993

(22) Filed: Dec. 8, 2016

(65) Prior Publication Data

US 2017/0167101 A1 Jun. 15, 2017

(30) Foreign Application Priority Data

Dec. 9, 2015 (EP) ..... 15198741

(51) Int. Cl.
*E02D 5/28* (2006.01)
*E02D 27/42* (2006.01)

(52) U.S. Cl.
CPC ..... *E02D 5/285* (2013.01); *E02D 27/425* (2013.01); *E02D 2200/1685* (2013.01); *E02D 2300/0029* (2013.01)

(58) Field of Classification Search
CPC ..... E02D 5/285; E02D 2200/1685; E02D 2300/0029
See application file for complete search history.

(56) References Cited

U.S. PATENT DOCUMENTS

| | | | | |
|---|---|---|---|---|
| 3,986,369 | A * | 10/1976 | Rusche | E02D 5/285 405/232 |
| 8,307,593 | B2 * | 11/2012 | Bagepalli | E02D 27/42 52/223.3 |
| 9,249,784 | B2 * | 2/2016 | Larsen | F03D 13/25 |
| 9,523,211 | B2 * | 12/2016 | Betran Palomas | E04H 12/16 |
| 9,777,713 | B2 * | 10/2017 | Sato | F03D 13/10 |
| 2011/0138704 | A1 * | 6/2011 | Bagepalli | E04H 12/12 52/147 |
| 2013/0175017 | A1 * | 7/2013 | Goto | B21D 11/14 165/181 |
| 2013/0309023 | A1 * | 11/2013 | Takagi | B21C 37/158 405/231 |
| 2014/0318033 | A1 | 10/2014 | Coordes | |

FOREIGN PATENT DOCUMENTS

| | | | |
|---|---|---|---|
| DE | 102011085947 | 5/2013 | |
| EP | 2781673 A1 * | 9/2014 | E04H 12/16 |

OTHER PUBLICATIONS

European Search Report from corresponding EPO Appln. No. 15198741.9 dated Apr. 26, 2016.

* cited by examiner

*Primary Examiner* — Benjamin F Fiorello
(74) *Attorney, Agent, or Firm* — Grossman, Tucker, Perreault & Pfleger, PLLC

(57) ABSTRACT

The invention refers to a pile for an offshore monopile type foundation structure comprising an elongate cylindrical steel tube comprising a first length with a first wall thickness, a second length with a second wall thickness, wherein the second length comprises several reinforcement ribs extending longitudinally and equally spaced apart from each other over the entire second length.

17 Claims, 3 Drawing Sheets

PILE FOR AN OFFSHORE MONOPILE TYPE FOUNDATION STRUCTURE

FIELD OF THE INVENTION

The invention refers to a pile for an offshore monopile type foundation structure comprising an elongate cylindrical steel tube.

BACKGROUND

Piles are generally well known structures for establishing offshore foundations.

Recently offshore wind power has become more and more popular and important. Generally offshore wind power refers to the construction of wind farms in bodies of water to generate electricity from wind. Offshore wind farms include fixed-bottom wind turbine technologies in shallow water areas, often referred to as near shore wind power. Wind turbines and electrical substations are typically arranged on so called monopile foundations or jacket foundations or tripods or the like which are fixed on the seabed in shallow water subsea locations. Many offshore wind farms utilize monopile foundations. Monopiles are normally steel tubes or steel pipes of large diameter, for example with a diameter of about 4 m which are sunk 25 m deep into the seabed. The piles are normally rammed or vibrated or drilled into the seabed. Generally the load bearing capacity of a driven pile depends on its embedded length and the compression of the surrounding soil. The more friction acts on the sides of the pile the bigger is the load bearing capacity.

Of course the load bearing capacity also depends on the buckling resistance of the pile itself and on erosion around the pile incurred by currents and waves. Wave-slamming has also to be considered when calculating the load bearing capacity of the pile. Generally piles are driven into the seabed by impact driving or by vibrating or by combinations thereof.

Since each proposed construction site for offshore structural foundations can have different geological ground conditions there are certain design constrains as regards the stability of the pile in terms of wall thickness and choice of material. For example the wall thickness must be chosen so that the pile can withstand increased impact driving forces in the event of a non-expected increased driving resistance of the seabed. Generally it would be desirable to install monopiles with a reduced embedded depth, however this would mean that the diameter would have to be increased in order to avoid the risk of buckling. This however increases transportation and handling costs.

SUMMARY

It is therefore an object of the present invention to provide a pile for an offshore monopile type foundation structure which is improved in terms of load bearing capacity and at the same time is improved in terms of weight savings.

These and other objects are achieved by a pile for an offshore monopile type foundation structure comprising an elongate cylindrical steel tube comprising a first length with a first wall thickness, a second length with a second wall thickness, wherein the second length comprises several reinforcement ribs extending longitudinally and equally spaced apart from each other over the entire second length.

According to one aspect of the current invention there is provided a pile for an offshore monopile type foundation structure comprising an elongate cylindrical steel tube, comprising a first length with a first wall thickness and a second length with a second wall thickness, wherein the second length comprises several reinforcement ribs extending longitudinally and equally spaced apart from each other over the entire second length.

Longitudinally in the sense of the current application means that the reinforcement ribs extend in parallel to the centre line of the cylindrical steel tube. In particular due to the presence of the reinforcement ribs the area moment of inertia of the pile is increased. Thus the ribs reduce the risk of buckling and help increase the cross sectional area to combat fatigue without increased steel thickness.

In a particular preferred embodiment the ribs are in the form of hollow profiles which are open end to end. On the one hand this increases the buckling resistance of the ribs themselves, on the other hand the form of the ribs increases the friction of the pile relative to the soil and thus increasing the load capacity of the installed pile.

Preferably the reinforcement ribs are in the form of partly cylindrical or semi cylindrical profiles so that the cross section of the pile in the area of the second length has a kind of corduroy rib design.

In a particularly preferred embodiment of the pile according to the current invention the reinforcement ribs extend at an inner wall of the second length of the pile. It is within the scope of the current invention that the reinforcement ribs may also extend at an outer wall of the pile. Of course reinforcement ribs may also be provided at an inner wall and at an outer wall of the pile.

Advantageously the first wall thickness is greater than the second wall thickness. In other words thinner steel may be provided where reinforcement ribs are present. The pile according to the current invention may have a diameter of about 4 to 5 m and a first wall thickness of about 4 to 6 cm. A second wall thickness may be a reduced wall thickness which is less than the first wall thickness. The second wall thickness may be between 3 and 6 cm.

Preferably the reinforcement ribs are welded to a wall of the second length. Preferably the welds extend longitudinally, i.e. parallel to the centre axis of the pile.

In another preferred embodiment of the pile according to the current invention the wall of the second length includes perforations. If the perforations are arranged in the tidal area in the installed position of the pile they may reduce imposed wave loading by allowing waves to pass through and thereby enabling a reduction of stresses due to wave impact on the steel. The perforations may also be provided below the mud line in the seabed so that they can be used for grout penetration into the soil to improve the friction in the area of the soil/monopile interface.

Preferably perforations are provided in the wall between the reinforcement ribs.

According to one preferred embodiment of the pile according to the present invention the first length is a leading end of the pile for penetration of the seabed and the second length extends next to the leading end. The second length may form part of the embedded length of the pile in the installed position of the pile.

The pile according to the present invention may comprise a first length with a driving shoe/cutting shoe, a second length with reinforcement ribs and a reduced wall thickness and a third length which is basically without reinforcement ribs and perforations and were the wall thickness corresponds to the wall thickness of the leading end. The trailing end of the pile may comprise a flange for establishing a bolted connection with another pile and which may be optimized for driving the pile into the seabed.

The pile according to the current invention may include internal bracing in the area of the second length. Generally the reinforcement ribs may be obtained by small diameter piles which have been cut apart and welded to the inner wall of the pile.

The invention hereinafter will be explained by way of example with reference to the accompanying drawings.

DETAILED DESCRIPTION

Figure 1:
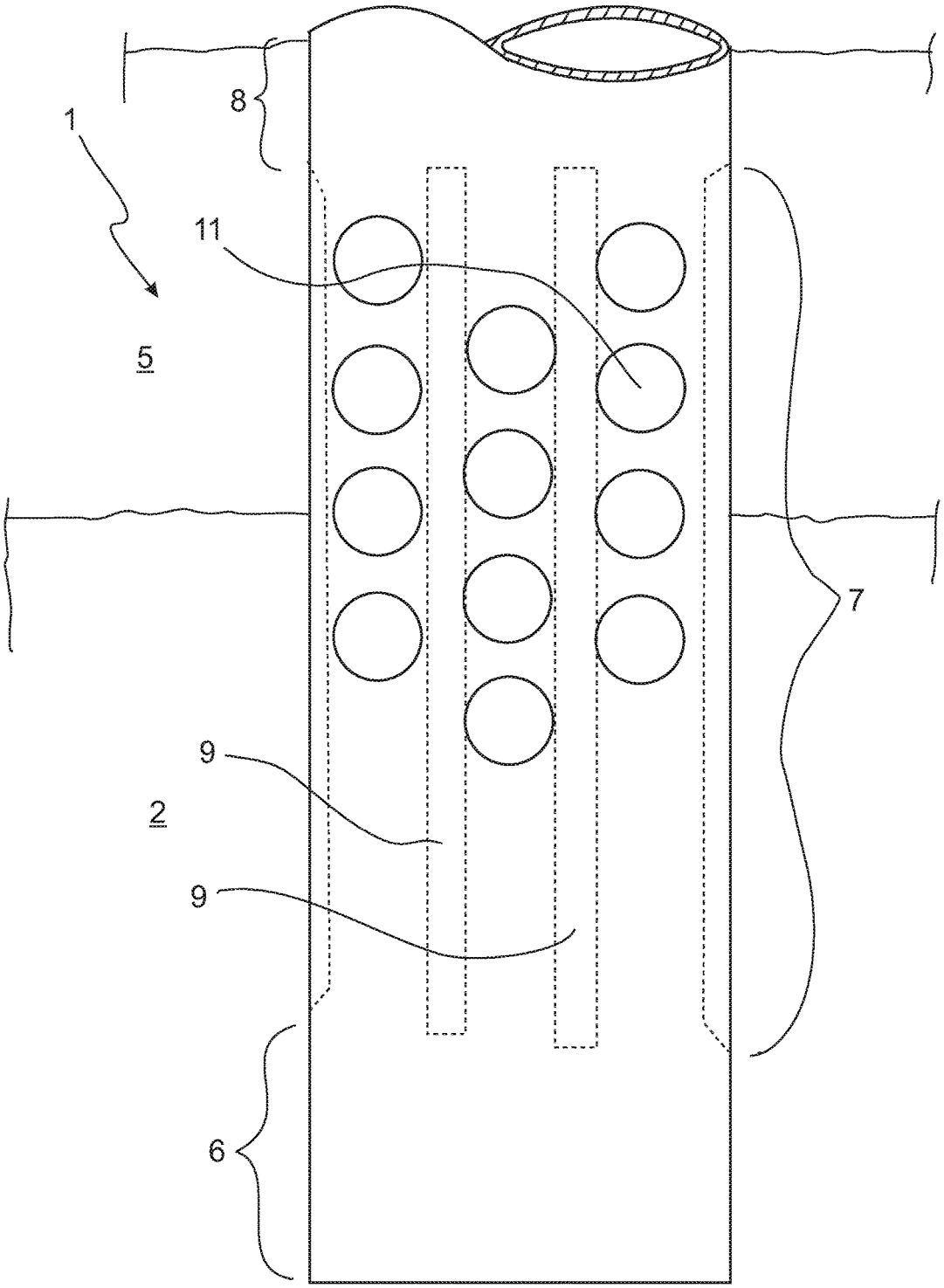
FIG. 1 shows a first embodiment of a pile according to the invention.

FIG. 1 shows the pile 1 according to the invention in the installed position, i.e. driven into a seabed 2.

The pile 1 according to the invention is a monopile for receiving a tower structure of a wind turbine generator or a platform for an electrical substation of a wind farm. The pile 1 has a leading end 3 which is designed as a cutting shoe or driving shoe for penetration into the seabed 2. The trailing end of the pile 1 is not shown in the drawings and may for example comprises a flange for establishing a bolted connection to another steel cylinder, pile section or connection profile of an offshore structure.

The pile 1 may have a diameter of about 4 to 5 m and a regular wall thickness of about 4 to 6 cm. The pile 1 may be designed as a cylindrical tube of steel which has been painted or coated to withstand the influence of salt water.

Figure 2:
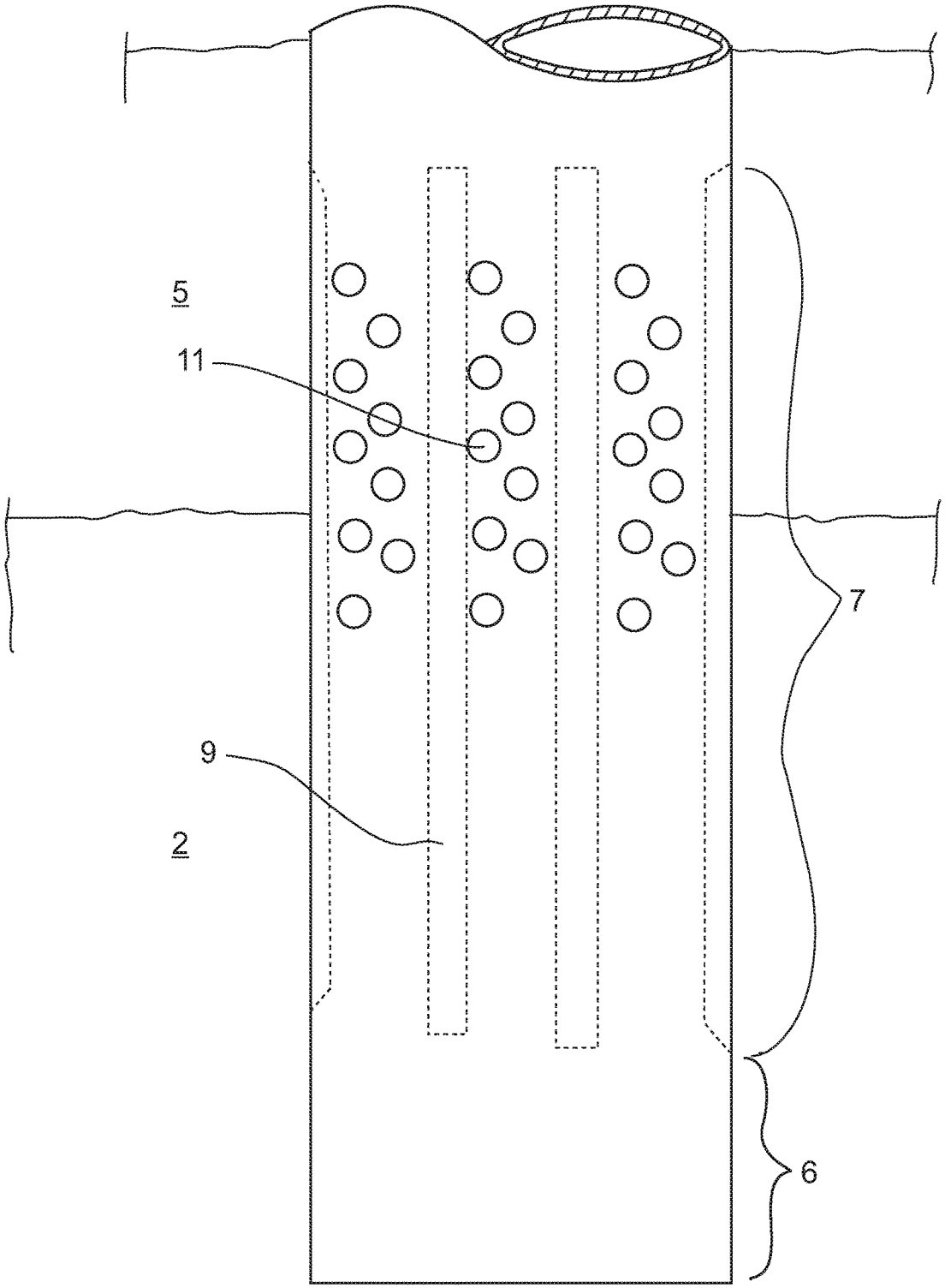
FIG. 2 a second embodiment of a pile according to the invention.

FIGS. 1 and 2 show the pile 1 in the installed position, reference number 4 denotes the mud line/sea ground. Above the mud line 4 the pile extends trough a body of water 5. The part of the pile 1 which is sunk into the seabed 2 is referred to as the embedded length.

Generally the pile 1 comprises a first length 6, a second length 7 and a third length 8. The first length 6 forms the leading end 3 of the pile 1, the second length 7 extends next to the first length 6 and the third length 8 extends next to the second length 7 up to the trailing end of the pile 1 which is not shown in the drawings.

The pile 1 comprises a plurality of reinforcement ribs 9 which extend at an inner wall 10 of the pile 1 over the entire second length 7 longitudinally, i.e. parallel to the centre line of the pile 1.

Figure 3:
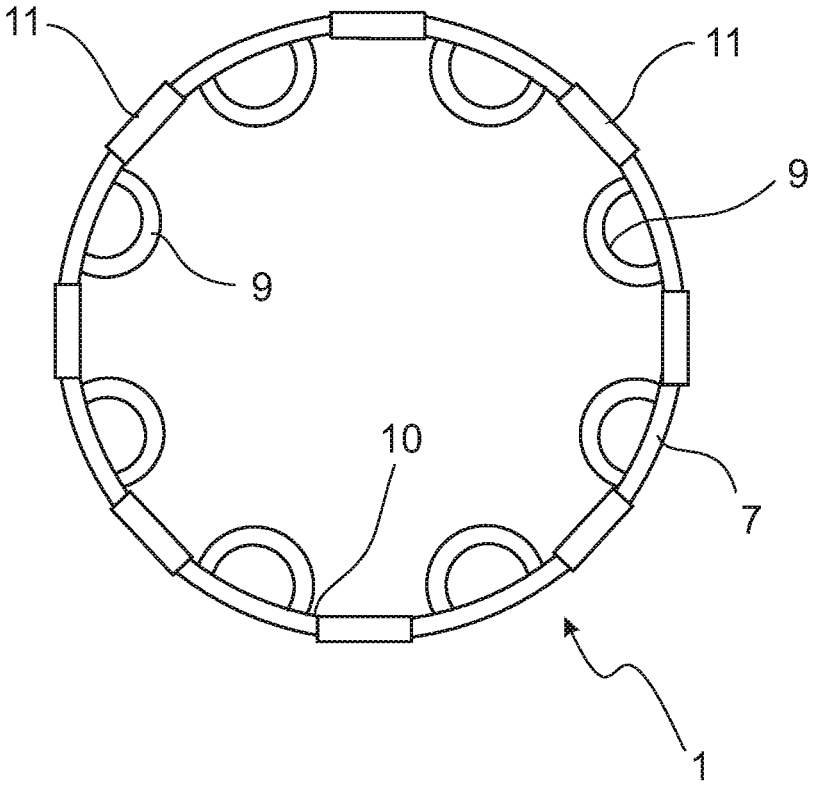
FIG. 3 a cross section through the pile according to FIG. 1.

As this may be taken from the cross section of FIG. 3 the reinforcement ribs 9 are designed as semi cylindrical profiles which may have been obtained by cutting apart of smaller diameter standard steel tubes.

The reinforcement ribs 9 at their longitudinally extending edges are welded to the inner wall 10 of the pile 1. The welds extend in the longitudinal direction of the pile, i.e. parallel to the centre line of the pile 1. The reinforcement ribs are equally spaced apart from each other at the inner wall 10 of the pile and are hollow. The reinforcement ribs 9 may be open end to end, however, alternatively the reinforcement ribs 9 may be closed at their ends.

In the embodiment of the pile 1 according to FIG. 1 the pile has over the first, second and third length 6, 7, 8 the same wall thickness. Between the reinforcement ribs 9 in the area of the second length 7 perforations 11 are provided. In the embodiment shown in FIGS. 1 and 2 the perforations 11 are circular, however, it will be appreciated that the perforations 11 may have any suitable shape like for instance rectangular, square, triangular, oval.

In the embodiment shown in FIG. 2 the first length 6 of the pile 1 has a first wall thickness and the second length of the pile has a second wall thickness, the second wall thickness being less than the first wall thickness. In other words thicker steel is used where there are no reinforcement ribs 9 and thinner steel is provided in the second length 7 where the reinforcement ribs 9 are provided. The third length 8 of the pile 1 may have the same wall thickness than the first length 6.

In the embodiment according to FIG. 2 the perforations 11 have a smaller diameter than the perforations 11 in the first embodiment. Apart from that the design of the piles 1 according to the first and second embodiment is similar.

REFERENCE NUMERALS

1. pile
2. seabed
3. leading end of the pile
4. mud line
5. body of water
6. first length
7. second length
8. third length
9. reinforcement ribs
10. inner wall of the pile
11. perforations

What is claimed is:

1. A pile for an offshore monopile type foundation structure comprising:

an elongate cylindrical steel tube comprising a first length with a first wall thickness, and a second length with a second wall thickness, wherein the first wall thickness is different from the second wall thickness, and wherein the second length comprises several reinforcement ribs extending longitudinally and equally spaced apart from each other over the entire second length.

2. The pile according to claim 1, wherein the reinforcement ribs are in the form of hollow profiles.

3. The pile according to claim 2, wherein the hollow profiles are open end to end.

4. The pile according to claim 1, wherein the reinforcement ribs are in the form of partly cylindrical or semi cylindrical profiles.

5. The pile according to claim 1, wherein the reinforcement ribs extend at an inner wall of the second length.

6. The pile according to claim 1, wherein the first wall thickness is greater than the second wall thickness.

7. The pile according to claim 1, wherein the reinforcement ribs are welded to a wall of the second length.

8. The pile according to claim 1, wherein the wall of the second length includes perforations.

9. The pile according claim 8, wherein the perforations are provided in the wall between the reinforcement ribs.

10. The pile according to claim 1, wherein the first length is a leading end of the pile for penetrating a seabed and that the second length extends next to the leading end.

11. The pile according to claim 10, wherein the second length in the installed position of the pile forms part of the embedded length of the pile.

12. The pile according to claim 1, wherein the second length of the elongate cylindrical steel tube comprises a cylindrical wall, and wherein the reinforcement ribs are fixed to the cylindrical wall without extending completely through the cylindrical wall.

13. The pile according to claim 1, wherein the second length of the elongate cylindrical steel tube comprises a cylindrical wall having an outer side and an inner side, and wherein the reinforcement ribs are fixed to the inner side of the cylindrical wall without extending through the cylindrical wall to the outer side of the cylindrical wall.

14. The pile according to claim 1, wherein the second length of the elongate cylindrical steel tube comprises a cylindrical wall, and the reinforcement ribs are fixed to the cylindrical wall, and wherein each reinforcement rib of the reinforcement ribs fixed to the cylindrical wall forms a hollow enclosed conduit with the cylindrical wall which extends along the second length of the elongate cylindrical steel tube.

15. The pile according to claim 1, wherein the second length of the elongate cylindrical steel tube comprises a cylindrical wall having a first diameter, and each reinforcement rib of the reinforcement ribs comprises a semi-cylindrical wall having a second diameter, and wherein the second diameter is smaller than the first diameter.

16. The pile according to claim 1, wherein the reinforcement ribs are stationarily joined with the steel tube.

17. The pile according to claim 1, wherein the reinforcement ribs are formed of steel.

* * * * *